US005626339A

United States Patent [19]

Schickert et al.

[11] Patent Number: 5,626,339

[45] Date of Patent: May 6, 1997

[54] STRUCTURAL FOAM BASKETBALL BACKBOARD WITH INMOLD GRAPHICS

[75] Inventors: Randy R. Schickert, Kewaskum; James N. Fitzsimmons, Waukesha, both of Wis.

[73] Assignee: Huffy Corporation, Miamisburg, Ohio

[21] Appl. No.: 190,914

[22] Filed: Feb. 3, 1994

[51] Int. Cl.[6] ..... A63B 71/02

[52] U.S. Cl. ..... 473/481

[58] Field of Search ..... 273/1.5 R, 1.5 A; 52/309.4, 309.8, 309.9; 101/129

[56] References Cited

U.S. PATENT DOCUMENTS

| | | | |
|---|---|---|---|
| 3,964,743 | 6/1976 | Salsich, Sr. | 273/1.5 R |
| 4,402,262 | 9/1983 | Handforth | 101/129 |
| 4,424,968 | 1/1984 | Smith | 273/1.5 R |
| 4,731,279 | 3/1988 | Isshiki | 52/309.9 X |
| 5,224,699 | 7/1993 | Zaruba | 273/1.5 R |
| 5,354,049 | 10/1994 | Matherne et al. | 273/1.5 R |
| 5,433,432 | 7/1995 | Adler | 273/1.5 R |

OTHER PUBLICATIONS

Sportime catalog, 1993 Summer Edition, p. 135, Cast Aluminum Fan-Shaped Backboard Sep. 1993.

Huffy Youth Sports styrene basketball backboard (admitted pior art).

SureShot polystrene, structurally foamed basketball backboard (admitted prior art).

*Primary Examiner*—Paul E. Shapiro

*Attorney, Agent, or Firm*—Howrey & Simon; Richard S. Meyer

[57] ABSTRACT

A basketball backboard formed of a structural foam material such as structural foam polypropylene. The backboard is provided with an inmolded graphics sheet formed of the same material as that used to form the backboard. The graphics sheet of material is formed with pores to receive the printing inks whereby a desired visual graphics display is provided on an exposed facing surface of the graphics sheet. The backboard is formed as a high strength rigid structure having good rebound characteristics.

14 Claims, 5 Drawing Sheets

STRUCTURAL FOAM BASKETBALL BACKBOARD WITH INMOLD GRAPHICS

BACKGROUND OF THE INVENTION

The present invention relates to a basketball backboard and, more particularly, to a basketball backboard formed of a structural foam plastic material and having a graphics sheet molded into the face of the backboard.

Basketball backboards are currently made of a variety of materials and are commonly produced using a moldable plastic material. In one known backboard structure the backboard is formed of styrene which is injected into a straight injection mold to form the styrene into the final desired shape for the backboard. Further, such styrene backboards are typically formed as small backboards, i.e. less than 48 inches.

It is also known to provide the above-described styrene backboard with a front face having a graphics display to improve the appearance of the backboard. Typically, the graphics display is printed on a styrene sheet which is laid by hand into the mold for forming the backboard and alignment of the sheet is accomplished by aligning holes in the sheet on pins in the mold provided for producing the mounting holes in the backboard. Upon injecting styrene into the mold, the back portion of the graphics sheet is melted to cause it to be integrally joined to the face of the backboard.

Styrene is relatively easy to print on and therefore is conducive to the production of backboards which are provided with sheets having graphics printed thereon. However, there is a need for a molded backboard formed of a plastic material having greater structural strength than prior molded backboards and which is conducive to production of larger backboards, such as 48 inch backboards. In addition, it is desirable to provide such a backboard wherein the material forming the backboard is conducive to receiving a printed sheet of graphics material formed of the same material as that of the backboard.

SUMMARY OF THE INVENTION

The present invention provides a basketball backboard which is formed of a structural foam plastic material, such as a polyolefin, molded in an injection molding operation. By molding the backboard using a structural foam material, the backboard is provided with an internal cellular structure and has a tough external skin which provides good rebound characteristics.

In addition, the present invention includes a printed graphics sheet formed of a material compatible with the backboard material, such as one formed of the same base resin material. The graphics sheet is bonded to the backboard simultaneously with the molding operation of the backboard such that the graphics sheet is inmolded with the backboard structure. It has been found that there is greater difficulty associated with printing on polyolefin materials than with printing on the prior art styrene material in that the exterior surfaces of parts formed of polyolefin based materials are relatively non-porous and are therefore not receptive to printing inks. The present invention further provides a method of preparing the surface of the graphics sheet to ensure that a high resolution printed graphics sheet is provided for attachment to the backboard.

In one aspect of the present invention, a method of producing a basketball backboard of a structural foam material is provided comprising the steps of providing a mold, placing a graphics sheet in the mold wherein the graphics sheet is formed of a material which is compatible with the structural foam material and includes a printed side, and supplying a melt of structural foam material to the mold to thereby form a rigid backboard structure and simultaneously bond the graphics sheet to the backboard structure.

In a further aspect of the invention, the method includes registering a peripheral edge of the graphics sheet with a surface in the mold to align the graphics sheet relative to the mold. Preferably, the alignment surface in the mold defines a recess in the backboard extending around substantially the entire periphery of the graphics sheet.

In yet another aspect of the invention, both the graphics sheet and the backboard structure are formed of polyolefins including polyolefins having additives and fillers. In addition, the graphics sheet is corona treated during production of the sheet, prior to printing of the sheet, to thereby produce pores in the sheet for receiving ink during printing of the sheet, It is therefore an object of the present invention to provide a method of producing a molded structural foam backboard, It is another object of the present invention to provide a structural foam backboard having an inmolded graphics sheet attached thereto wherein the graphics sheet is formed of the same basic material, or other compatible material, as the structural foam backboard, Other objects and advantages of the invention will be apparent from the following description, the accompanying drawings, and the appended claims.

DETAILED DESCRIPTION OF THE PREFERRED EMBODIMENT

Figure 1:
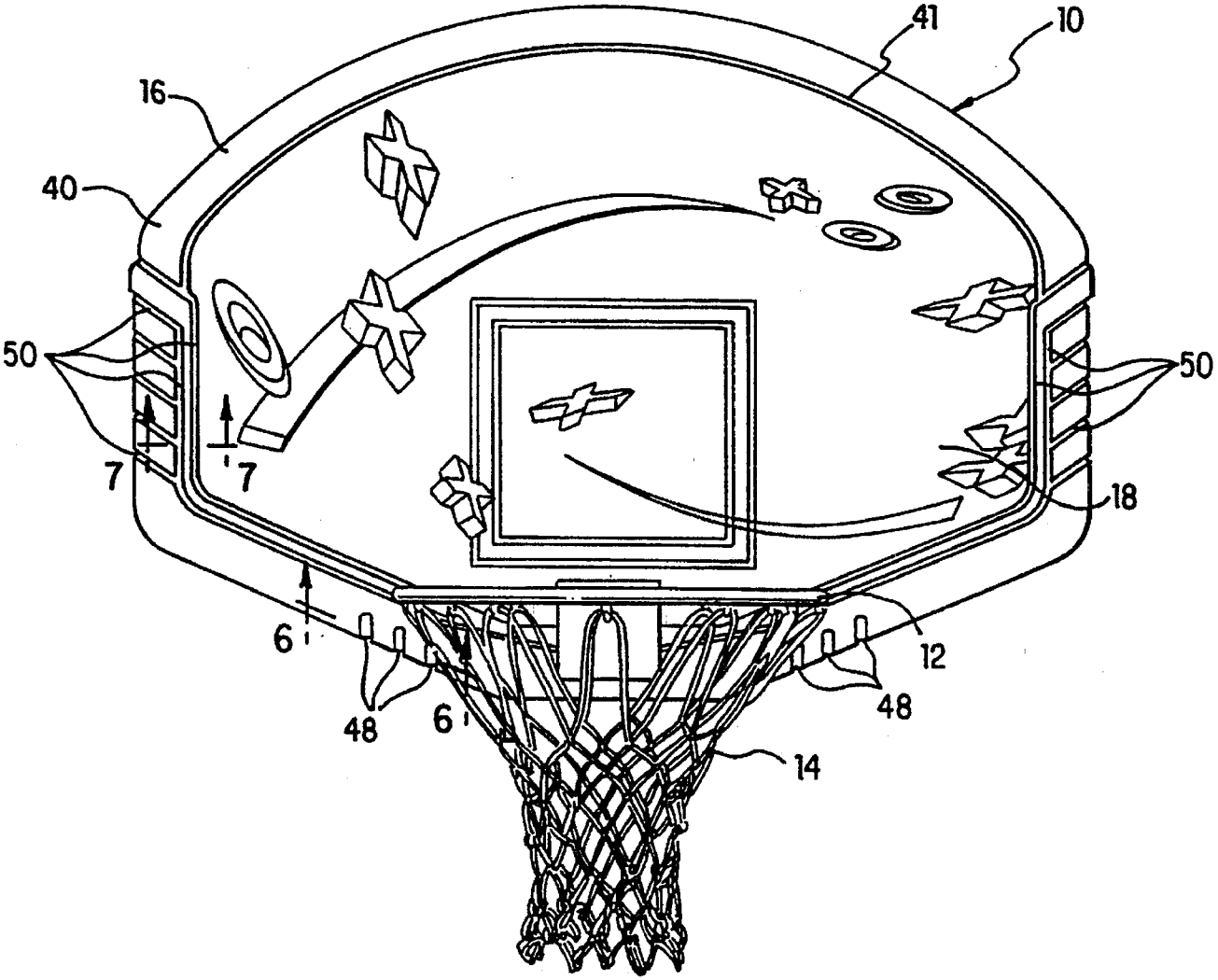
FIG. 1 is a front elevational view showing the backboard of the present invention.

Referring to FIG. 1, the backboard 10 of the present invention is illustrated having a hoop 12 and net 14 attached thereto. The backboard 10 includes a rigid backboard structure 16 and a thin graphics sheet 18 attached to the front face of the rigid structure 16.

In the preferred embodiment, both the rigid. backboard structure 16 and the graphics sheet 18 are formed of polyolefin based materials which comprise a family of materials including polypropylene and polyethylene. The graphics sheet 18, which is preferably formed of the same base resin material as the rigid structure 16, is inmolded into the rigid structure 16 such that the graphics sheet 18 is substantially integrally bonded to the rigid structure 16. The polyolefin material forming the rigid backboard structure 16 comprises a particularly strong and cost effective material for the rigid backboard structure 16. In addition, the rigid structure 16 is preferably molded into the desired backboard shape during a molding operation wherein the rigid structure 16 is formed as a molded structural foam structure. As will be described further below, the polyolefin material forming the rigid structure is shot into the mold to form a structural foam polyolefin backboard characterized by an internal cellular structure having a tough external skin to provide a high strength rigid backboard which has good rebound characteristics and which is resistant to cracking in cold weather. It should also be noted that the polyolefins forming the backboard for the present invention may include polyolefins having additives and fillers to obtain the desired characteristics for the backboard.

Figure 2:
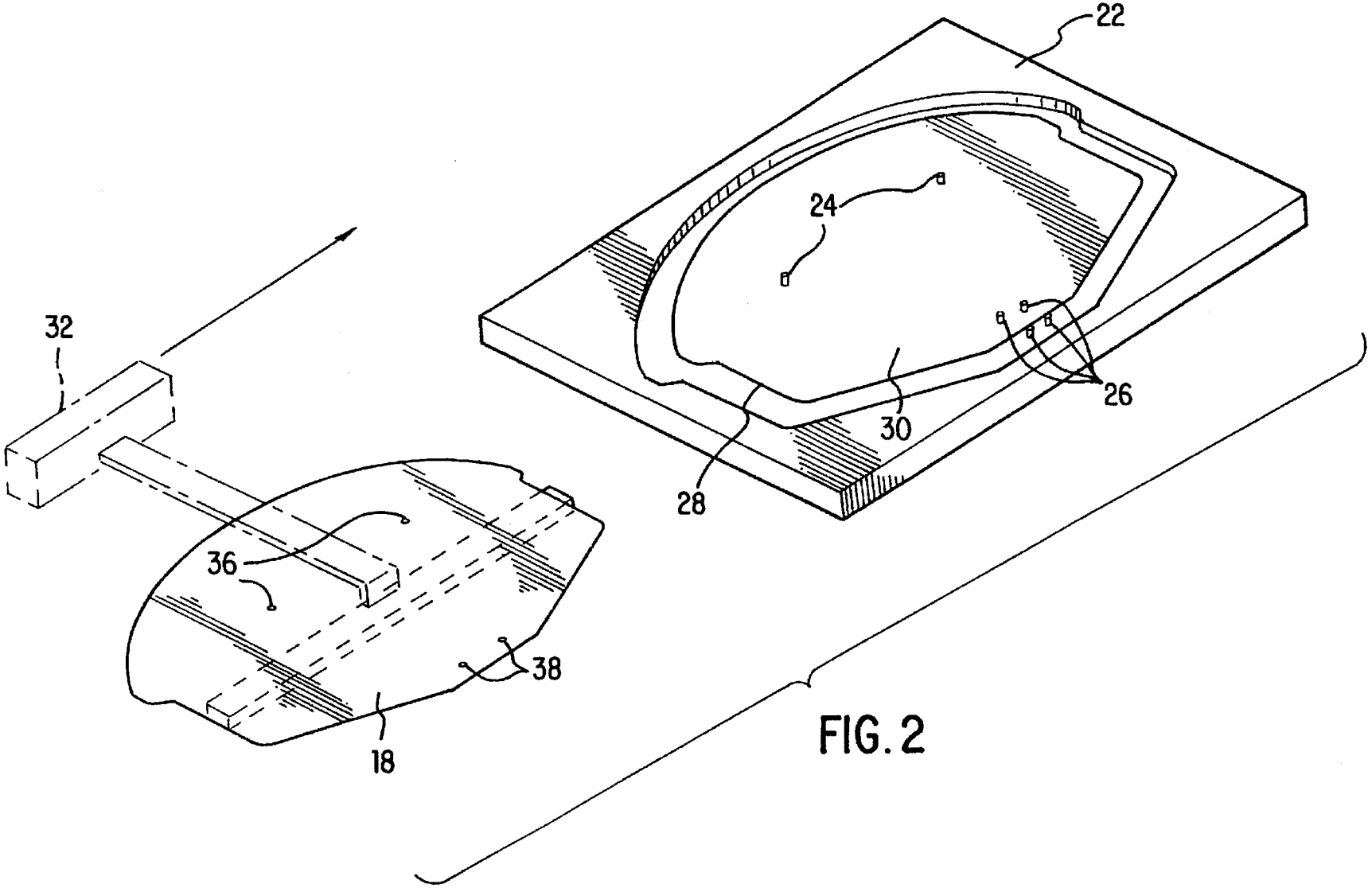
FIGS. 2–4 illustrate steps of the method for forming the backboard of the present invention.
Figure 3:
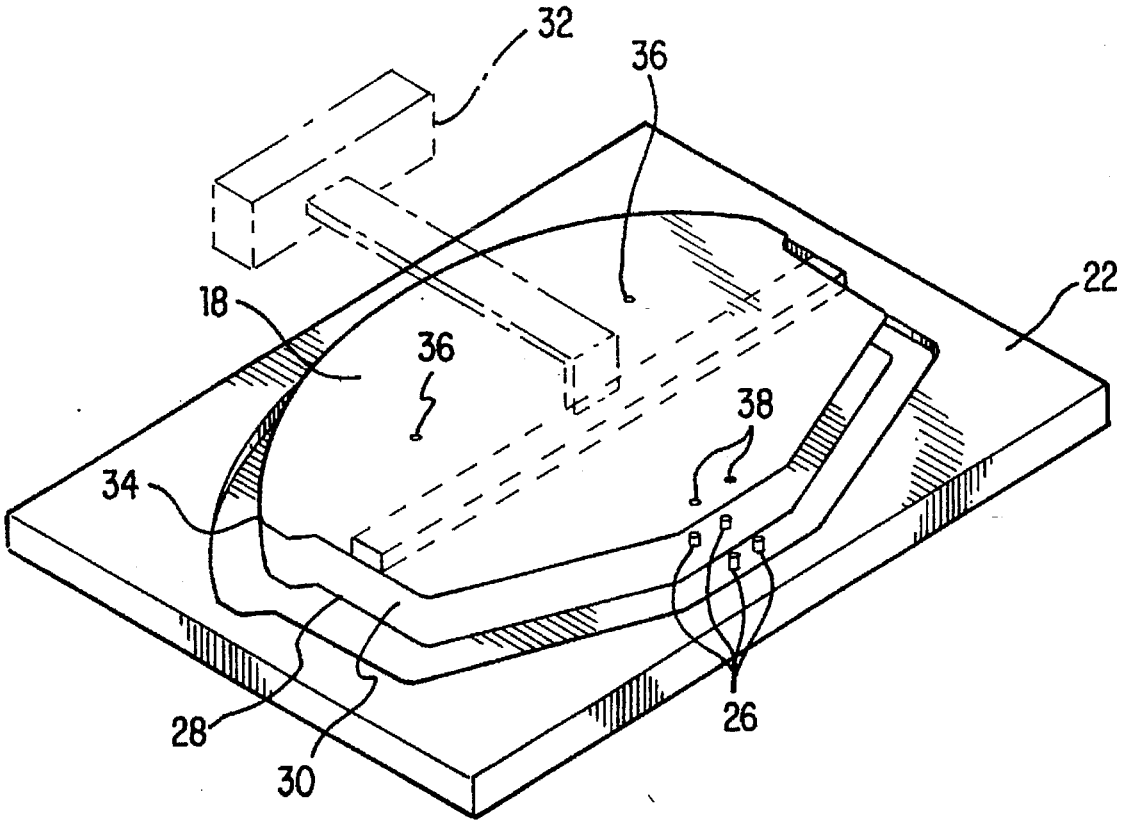
Figure 4:
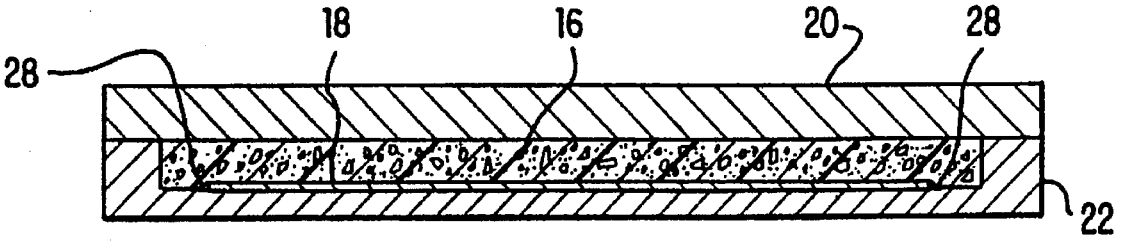

Referring to FIGS. 2–4, the backboard 10 is formed through a molding operation in a mold which may consist of a first or core half 20 and a second or cavity half 22. It should be understood that the mold shown in the figures is provided for illustrative purposes only to illustrate the steps of the method for forming the present backboard and that various details of the mold not required for the present description are not shown. Also, other mold configurations may be used within the scope of the present invention. The mold half 22 forms the front face of the backboard 10 and may include pins 24 for forming mounting holes in the backboard, and may further include pins 26 for forming mounting holes for the basketball hoop 12. In addition, a rib element 28 is provided extending from the bottom surface 30 of the mold half 22 a small distance for defining a recess 41 in the front face of the finished backboard 10.

Referring to FIGS. 2 and 3, a graphics sheet 18 is moved into association with the open second mold half 22, and in the preferred embodiment, the graphics sheet 18 is moved by an automated delivery means, depicted diagrammatically as element 32, which is adapted to grip and move the graphics sheet 18 to a desired location. When the graphics sheet 18 is adjacent to the surface 30 of the mold half 22, it is placed into engagement with the surface 30 such that a peripheral edge 34 of the graphics sheet 18 is in contact with a surface defined by the rib 28 around substantially the entire peripheral edge of the graphics sheet 18. In addition, the graphics sheet is provided with holes 36 and 38 for receiving the pins 24 and 26 therethrough. The surface defined by the rib 28 contacting the edge of the sheet 18, and the pins 24, 26 engaging in the holes 36, 38 facilitate proper alignment of the graphics sheet 18 within the mold.

It should be noted that the graphics sheet 18 includes a printed side on a front face thereof and that the printed side is placed face down toward the surface 30 as the sheet 18 is placed within the mold half 22.

Referring to FIG. 4, the top and bottom mold halves 20, 22 are then moved into engagement with each other and a melt of structural foam material is shot under pressure into the mold cavity. When the structural foam material forming the rigid backboard structure 16 comes into contact with the unprinted back surface of the graphics sheet 18, the back portion of the graphics sheet 18 will melt to cause it to become integrally joined to the backboard structure 16. In the finished backboard 10, the graphics sheet 18 covers a substantial portion of the front area forming the rebound surface and is surrounded by a relatively narrow border area 40 with the recess 41 formed by the rib 28 located between the edge of the graphics sheet 18 and the border area 40. The border area 40 and front printed face of the graphics sheet 18 preferably lie in substantially the same plane.

Figure 6:
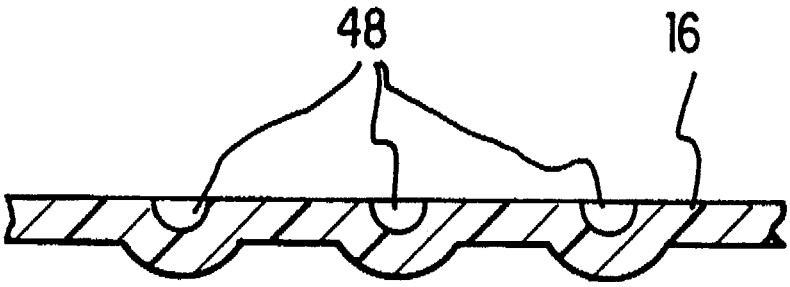
FIG. 6 is a cross-sectional view taken along line 6—6 in FIG. 1.
Figure 7:
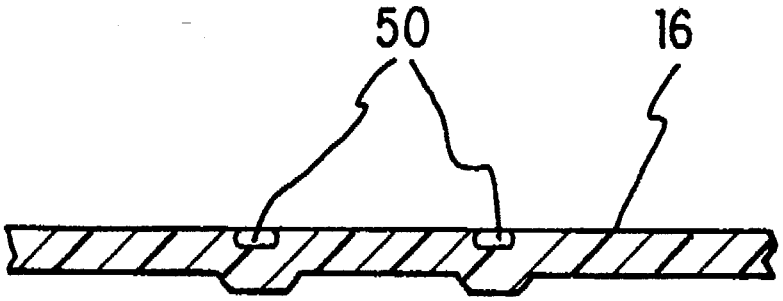
FIG. 7 is a cross-sectional view taken along line 7—7 in FIG. 1.

In addition, as may be seen in FIGS. 1, 6 and 7, the front face of the backboard 10 may be provided with further molded in recesses, such as recesses 48 and 50. The recesses 48 and 50 act to provide the front face of the backboard with a three-dimensional sculpted appearance in the border area 40 surrounding the graphics sheet 18. Thus, the recesses 48 and 50 function as a further graphics enhancing feature for the backboard 10 defining predetermined sculpted patterns on the face of the backboard.

Polyolefin materials are resistant to degradation making such materials desirable for a basketball backboard intended for outdoor use. However, the same characteristics which make polyolefin materials resistant to degradation also make them resistant to receiving inks during a printing process. Specifically, parts formed of polyolefins have a substantially non-porous external skin or surface which is not receptive to printing with conventional printing inks. Accordingly, the graphics sheet 18 of the present invention is treated to ensure that it will accept printing inks. In particular, during the production of the graphics sheet 18, prior to printing on the sheet, the side of the sheet 18 to be printed on is subjected to a corona treatment which imparts a positive charge to the sheet 18 and opens up a plurality of small pores on the sheet. The sheet is then subjected to a printing process wherein printing ink is trapped within the small pores to provide the desired graphics appearance for the sheet 18. Finally, the printed side of the sheet is coated with a U.V. coating in a silk screen process to form a laminate-like outer surface which is resistant to the deleterious effects of the weather and sun rays. Thus, the present invention provides a basketball backboard structure including an inmolded printed graphics sheet wherein the graphics sheet 18 is subjected to a particular process which permits the graphics sheet to be receptive to ink applied during a printing process.

It should be noted that it is important that the graphics sheet 18 be formed of the same base material as the polyolefin material forming the rigid structure 16 in that the polyolefin material has a relatively high shrink rate during a molding operation, as compared to other moldable materials such as styrene, for example. Thus, the shrink rate of the graphics sheet needs to be compatible or matched to the shrink rate of the rigid structure in order to avoid problems such as bowing or warping of the backboard as the backboard cools during the molding operation. In addition, forming the graphics sheet 18 and rigid structure 16 of chemically compatible materials facilitates the bonding which occurs between these elements during the molding operation.

Figure 5:
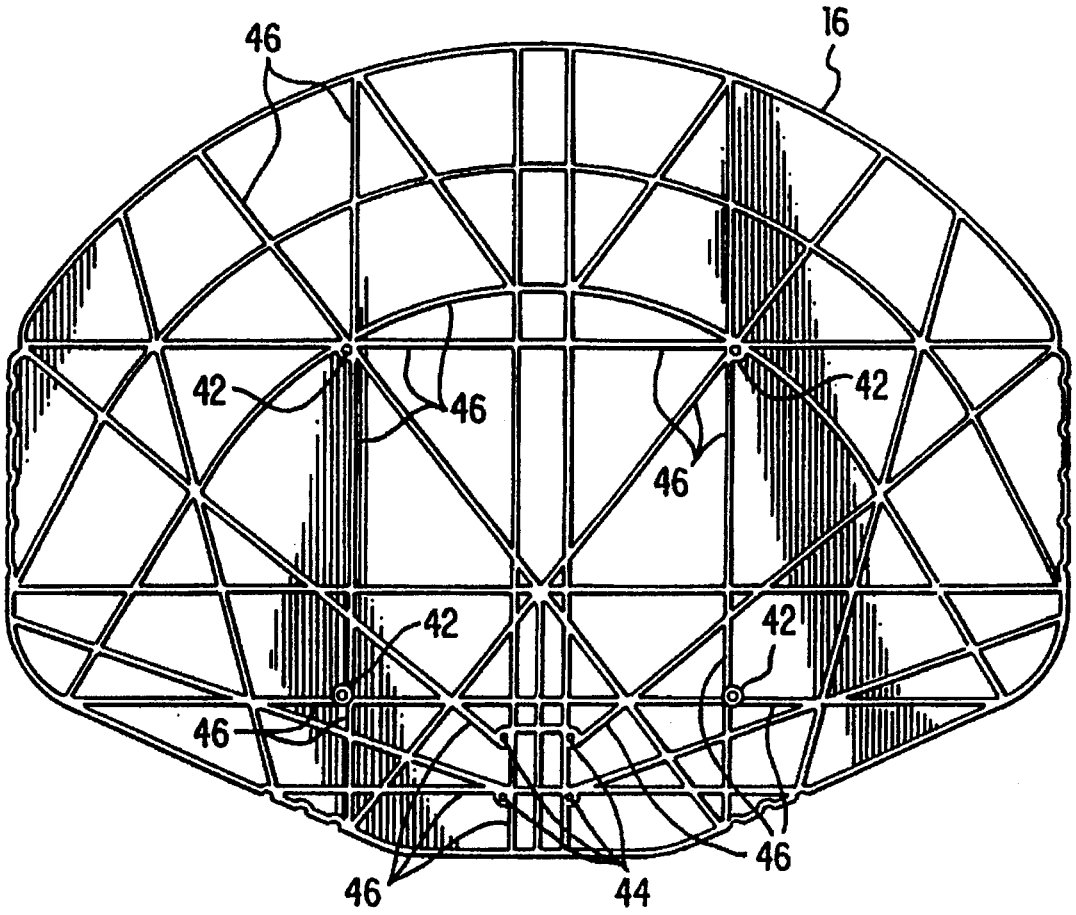
FIG. 5 is a rear elevational view of the backboard.

Referring to FIG. 5, it can be seen that the backboard 10 is provided with ribs 46 forming a reinforcing rib structure on the back side thereof. Further, it should be noted that the ribs 46 are arranged such that they extend along lines which pass tangential to backboard mounting apertures 42 and hoop mounting apertures 44 formed in the backboard 10 during the molding process. It has been found that by locating the ribs 46 tangential to the apertures 42, 44, as opposed to intersecting the apertures, the ribs are formed as uninterrupted structures such that the strength of the ribs continues along a line past the apertures 42, 44 whereby the structural foam material forming the rigid structure 16 is provided with greater structural strength in the area of the apertures 42, 44.

Further, it should be noted that the use of polyolefins for the present backboard provides a cost effective and strong structural material which is particularly conducive to constructing larger backboards, such as 48 inch backboards.

From the above description, it should be apparent that the present invention provides a basketball backboard formed of a structural foam material and including an inmolded printed graphics sheet.

Further, the present invention provides such a backboard having a graphics sheet which has been treated to facilitate printing directly on the structural foam graphics sheet material. Thus,, the use of a printed polyolefin graphics sheet on a structural foam backboard formed of the same base material is facilitated through the above-described method.

While the method and article herein described constitute preferred embodiments of the invention, it is to be understood that the invention is not limited to this precise method and article, and that changes may be made therein without departing from the scope of the invention, which is defined in the appended claims.

What is claimed is:

1. A basketball backboard comprising:

a rigid backboard structure formed from molded plastic defining a front face and a rear face, said front face including graphics and a border area surrounding said graphics, and at least one recess defining a sculpted three-dimensional appearance in said front face, said at least one recess being formed in said border area during molding of the backboard structure.

2. The basketball backboard as in claim 1, wherein said at least one recess comprises a plurality of recesses formed in said front face.

3. The basketball backboard as claimed in claim 1, wherein said graphics comprises a printed graphics sheet.

4. The basketball backboard as in claim 3, wherein said backboard structure and said graphics sheet are formed from structural foam materials.

5. The basketball backboard as in claim 4, wherein said at least one recess comprises a peripheral groove disposed on said front face around a periphery of said printed graphics sheet, thereby defining an inner boundary of said border area.

6. The basketball backboard as in claim 5 wherein said backboard structure and said graphics sheet are joined together in a mold, with said peripheral groove being formed by a rib positioning said graphics sheet within the mold.

7. The basketball backboard as in claim 6 wherein said rib surrounds and positions the entire periphery of said graphics sheet in the mold whereby said peripheral groove surrounds said printed graphics sheet.

8. The basketball backboard as in claim 1, wherein said at least one recess comprises a peripheral groove disposed on said front face around said graphics, thereby defining an inner boundary of said border area.

9. The basketball backboard as in claim 8, further comprising at least one second recess disposed in said border area and extending at an angle from the outer periphery of the backboard structure into said peripheral groove.

10. The basketball backboard as in claim 1, further comprising at least one second recess disposed at an angle relative to said one recess.

11. The basketball backboard as in claim 10 wherein said at least one second recess is disposed in said border area and extends inwardly from the outer periphery of the backboard structure.

12. A basketball backboard comprising:

a backboard structure formed of a structural foam material;

a sheet of graphics material attached to a front face of said backboard structure;

a recess formed in said front face of said backboard structure adjacent to substantially the entire periphery of said sheet of graphics material; and wherein said sheet of graphics material includes a printed side facing away from said backboard structure.

13. The basketball backboard as in claim 12 including a border portion defining a surface lying in substantially the same plane as said printed side of said sheet of graphics material wherein said recess is located between a peripheral edge of said sheet of graphics material and said border portion.

14. A basketball backboard comprising:

a backboard structure formed of a structural foam material;

a sheet of graphics material attached to a front face of said backboard structure, said sheet of graphics material including a printed side facing away from said backboard structure; and a border portion on said front face surrounding said sheet of graphics material, said border portion including grooves defining a sculpted three-dimensional appearance on said front face.

* * * * *